US011087669B2

(12) United States Patent
Lu et al.

(10) Patent No.: US 11,087,669 B2
(45) Date of Patent: Aug. 10, 2021

(54) GATE DRIVE CIRCUIT, DRIVING METHOD THEREOF AND DISPLAY DEVICE

(71) Applicants: Beijing BOE Optoelectronics Technology Co., Ltd., Beijing (CN); BOE Technology Group Co., Ltd., Beijing (CN)

(72) Inventors: Zhenghua Lu, Beijing (CN); Zongze He, Beijing (CN); Shuo Li, Beijing (CN); Yuxuan Chen, Beijing (CN); Xiuyun Chen, Beijing (CN)

(73) Assignees: Beijing BOE Optoelectronics Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/646,760

(22) PCT Filed: Mar. 28, 2019

(86) PCT No.: PCT/CN2019/080118
§ 371 (c)(1),
(2) Date: Mar. 12, 2020

(87) PCT Pub. No.: WO2019/184985
PCT Pub. Date: Oct. 3, 2019

(65) Prior Publication Data

US 2020/0273396 A1 Aug. 27, 2020

(30) Foreign Application Priority Data

Mar. 30, 2018 (CN) ..... 201810277584.5

(51) Int. Cl.
*G09G 3/20* (2006.01)

(52) U.S. Cl.
CPC ... *G09G 3/2092* (2013.01); *G09G 2300/0408* (2013.01); *G09G 2300/0814* (2013.01);
(Continued)

(58) Field of Classification Search
CPC ..... G09G 3/2092; G09G 2300/0408; G09G 2300/0814; G09G 2310/0267; G09G 2310/0275; G09G 2370/08; G09G 3/20
See application file for complete search history.

(56) References Cited

U.S. PATENT DOCUMENTS 5,216,417 A * 6/1993 Honda ..... G09G 3/2092 345/89
5,270,696 A * 12/1993 Shin ..... G09G 3/3685 345/204

(Continued)

FOREIGN PATENT DOCUMENTS

CN 1591536 A 3/2005
CN 101004902 A 7/2007

(Continued)

*Primary Examiner* — Jose R Soto Lopez

(57) ABSTRACT

A gate drive circuit, a driving method thereof and a display device are disclosed. The gate drive circuit, includes: a plurality of scanning output terminals and a decoder circuit. The decoder circuit includes a plurality of input terminals and a plurality of output terminals; the plurality of output terminals of the decoder circuit are in one-to-one correspondence with the plurality of scanning output terminals; the plurality of input terminals of the decoder circuit are configured to receive a parallel data frame; and the decoder circuit is configured to output a trigger signal for generating a scanning signal at an output terminal, which is corresponding to the parallel data frame, of the decoder circuit when receiving of the parallel data frame outputted by the latch circuit is accomplished, so as to allow a scanning output terminal corresponding to the parallel data frame outputs the scanning signal.

18 Claims, 4 Drawing Sheets

(52) U.S. Cl.
CPC ..... *G09G 2310/0267* (2013.01); *G09G 2310/0275* (2013.01); *G09G 2370/08* (2013.01)

(56) References Cited

U.S. PATENT DOCUMENTS 5,598,176 A * 1/1997 Klingenfus ..... G01R 13/407 345/35
6,747,626 B2 * 6/2004 Chiang ..... G09G 3/2011 345/100
9,378,667 B2 * 6/2016 Su ..... G09G 3/3674
9,754,535 B2 * 9/2017 Ohara ..... G09G 3/3225
2001/0040536 A1 * 11/2001 Tajima ..... G09G 3/20 345/55
2002/0024511 A1 * 2/2002 Ozawa ..... G09G 3/3648 345/204
2002/0041278 A1 * 4/2002 Matsueda ..... G09G 3/20 345/204
2004/0160391 A1 * 8/2004 Shigeta ..... G09G 3/2965 345/60
2004/0160432 A1 * 8/2004 Kubota ..... G09G 3/3266 345/204
2004/0263461 A1 * 12/2004 Park ..... G09G 3/3688 345/98
2005/0062733 A1 * 3/2005 Morita ..... G09G 3/3688 345/204
2005/0206535 A1 * 9/2005 Ishiyama ..... H03M 9/00 341/1
2005/0285830 A1 * 12/2005 Iwabuchi ..... G09G 3/20 345/77
2006/0120203 A1 * 6/2006 Kageyama ..... G09G 3/3688 365/230.06
2006/0208996 A1 * 9/2006 Tachibana ..... G09G 3/20 345/100
2006/0267623 A1 * 11/2006 Yoo ..... G01R 31/3187 324/760.01
2007/0001971 A1 * 1/2007 Kumagai ..... G09G 5/363 345/98
2007/0001972 A1 * 1/2007 Kumagai ..... G09G 5/363 345/98
2007/0001974 A1 * 1/2007 Kumagai ..... G09G 3/20 345/98
2007/0001975 A1 * 1/2007 Kumagai ..... G09G 3/20 345/98
2007/0002063 A1 * 1/2007 Kumagai ..... G09G 3/3688 345/562
2007/0045659 A1 * 3/2007 Abe ..... G09G 3/3696 257/152
2007/0052657 A1 * 3/2007 Ozawa ..... G09G 3/3659 345/100
2007/0146355 A1 * 6/2007 Bae ..... G09G 3/3696 345/204
2007/0171161 A1 * 7/2007 Lin ..... G09G 3/3685 345/87
2008/0218389 A1 * 9/2008 Yamagata ..... H03M 9/00 341/100
2008/0303767 A1 * 12/2008 Ludden ..... H04N 9/69 345/89
2010/0001929 A1 * 1/2010 Kawabe ..... G09G 3/3208 345/55
2010/0066720 A1 * 3/2010 Kawabe ..... G09G 3/3258 345/213
2010/0295841 A1 * 11/2010 Matsuda ..... G09G 3/3685 345/213
2010/0309173 A1 * 12/2010 Matsuda ..... G09G 3/3674 345/204
2011/0063262 A1 * 3/2011 Umezaki ..... G11C 19/28 345/204
2012/0154186 A1 * 6/2012 Hassan ..... H03M 9/00 341/100
2012/0169678 A1 * 7/2012 Shin ..... G09G 3/20 345/204
2013/0106804 A1 * 5/2013 John ..... H03M 9/00 345/204
2014/0313108 A1 * 10/2014 Kim ..... G09G 3/3266 345/76
2015/0262528 A1 * 9/2015 Takahara ..... G09G 3/3258 345/212
2016/0094224 A1 * 3/2016 Tamura ..... G11C 11/00 326/102
2016/0180823 A1 * 6/2016 Cho ..... G09G 5/18 345/567
2016/0372024 A1 * 12/2016 Lim ..... G09G 3/3677
2017/0084237 A1 * 3/2017 Kang ..... G09G 3/20
2017/0345372 A1 * 11/2017 Xiao ..... G09G 3/3266
2018/0090088 A1 * 3/2018 He ..... H03K 19/20
2019/0066615 A1 * 2/2019 Zhang ..... G09G 3/20
2019/0164467 A1 * 5/2019 Seo ..... G09G 3/3266
2020/0302886 A1 * 9/2020 Kasuo ..... G02F 1/133

FOREIGN PATENT DOCUMENTS

CN 105448226 A 3/2016
CN 107633805 A 1/2018
CN 108447436 A 8/2018

* cited by examiner

GATE DRIVE CIRCUIT, DRIVING METHOD THEREOF AND DISPLAY DEVICE

CROSS REFERENCE TO RELATED APPLICATIONS

The application is a U.S. National Phase Entry of International Application No. PCT/CN2019/080118 filed on Mar. 28, 2019, designating the United States of America and claiming priority to Chinese Patent Application No. 201810277584.5, filed on Mar. 30, 2018. The present application claims priority to and the benefit of the above-identified applications and the above-identified applications are incorporated by reference herein in their entirety.

TECHNICAL FIELD

Embodiments of the present disclosure relate to a gate drive circuit, a driving method thereof and a display device.

BACKGROUND

An array substrate generally includes a plurality of rows of gate lines and a plurality of columns of data lines which are intersected with each other. The gate line can be driven by an integrated driving circuit attached onto the array substrate. With the continuous improvement of the amorphous silicon thin film processes in recent years, the gate drive circuit may also be directly integrated on a thin-film transistor (TFT) array substrate to form a gate driver on array (GOA) on the array substrate, so as to drive the gate lines.

Compared with the traditional technology, GOA technology not only can omit a circuit board carrying a gate driver chip, achieve the symmetrical design of both sides of the display panel, but also can omit the chip binding area and the wiring area (such as a fan-out area) disposed at the edge of the display panel, which is in favor of realizing narrow-bezel design.

SUMMARY

At least one embodiment of the present disclosure provides a gate drive circuit, and the gate drive circuit comprises: a plurality of scanning output terminals and a decoder circuit. The decoder circuit comprises a plurality of input terminals and a plurality of output terminals; the plurality of output terminals of the decoder circuit are in one-to-one correspondence with the plurality of scanning output terminals; the plurality of input terminals of the decoder circuit are configured to receive a parallel data frame; and the decoder circuit is configured to output a trigger signal for generating a scanning signal at an output terminal, which is corresponding to the parallel data frame, of the decoder circuit when receiving of the parallel data frame outputted by the latch circuit is accomplished, so as to allow a scanning output terminal corresponding to the parallel data frame outputs the scanning signal.

For example, in at least one example of the gate drive circuit, the gate drive circuit further comprises: a serial-to-parallel conversion circuit and a latch circuit connected with the serial-to-parallel conversion circuit. The serial-to-parallel conversion circuit configured to receive a serial data frame and convert the serial data frame into the parallel data frame; the latch circuit is configured to receive and store the parallel data frame and output the parallel data frame after receiving of the data frame is accomplished; and the decoder circuit is connected with the latch circuit to receive the parallel data frame outputted by the latch circuit and configured to output the trigger signal for generating the scanning signal at the output terminal, which is corresponding to the parallel data frame, of the decoder circuit when receiving of the data frame outputted by the latch circuit is accomplished.

For example, in at least one example of the gate drive circuit, the decoder circuit comprises an address decoder; the parallel data frame comprises parallel address data; the address decoder comprises a plurality of input terminals and a plurality of output terminals; each of the plurality of input terminals of the address decoder is configured to receive one-bit data of the parallel address data; and the address decoder is configured to output the trigger signal for generating the scanning signal through an output terminal, which is corresponding to the parallel address data, of the address decoder after receiving of the parallel address data is accomplished.

For example, in at least one example of the gate drive circuit, the address decoder is an m-to-n decoder; and m is equal to a number of the input terminals of the address decoder, and n is equal to a number of the output terminals of the address decoder.

For example, in at least one example of the gate drive circuit, the m-to-n decoder comprises at least one 2-to-4 decoder.

For example, in at least one example of the gate drive circuit, the decoder circuit further comprises a mode decoder; the parallel data frame further comprises parallel mode data, and the parallel mode data and the parallel address data are parallel to each other in the parallel data frame; and the mode decoder is configured to allow all the output terminals of the decoder to not output the trigger signal for generating the scanning signal when the parallel mode data correspond to an all-turned-off mode or all output the trigger signal for generating the scanning signal.

For example, in at least one example of the gate drive circuit, the mode decoder comprises an all-turned-off decoder; and the all-turned-off decoder is configured to provide an invalid signal for an enable terminal of the address decoder when the parallel mode data correspond to the all-turned-off mode, so that all the output terminals of the decoder do not output the trigger signal for generating the scanning signal.

For example, in at least one example of the gate drive circuit, the all-turned-off decoder comprises a first AND gate; the parallel mode data comprise first bit data and second bit data; a first input terminal of the first AND gate is configured to receive data that have a phase-inverted relationship with the first bit data; a second input terminal of the first AND gate is configured to receive the second bit data; and an output terminal of the first AND gate is configured to be connected with the enable terminal of the address decoder.

For example, in at least one example of the gate drive circuit, the mode decoder comprises an all-turned-on decoder; and the all-turned-on decoder is configured to allow all the output terminals of the decoder to all output the trigger signal for generating the scanning signal when the parallel mode data correspond to the all-turned-on mode.

For example, in at least one example of the gate drive circuit, the all-turned-on decoder comprises a second AND gate and a plurality of OR gates; the parallel mode data comprise first bit data and second bit data; a first input terminal of the second AND gate is configured to receive the first bit data; a second input terminal of the second AND gate is configured to receive the second bit data; an output terminal of the second AND gate is configured to be connected with a first input terminal of each OR gate of the plurality of OR gates; and second input terminals of the plurality of OR gates are respectively connected with the plurality of output terminals of the address decoder.

For example, in at least one example of the gate drive circuit, the gate drive circuit further comprises an electrical level conversion circuit. The electrical level conversion circuit is configured to receive the trigger signal for generating the scanning signal, convert the trigger signal for generating the scanning signal into the scanning signal, and allow the scanning signal to be outputted through the scanning output terminal corresponding to the parallel data frame.

For example, in at least one example of the gate drive circuit, the gate drive circuit further comprises a serial data interface. The serial-to-parallel conversion circuit is connected with the serial data interface to receive the serial data frame through the serial data interface.

For example, in at least one example of the gate drive circuit, the serial data interface comprises a serial data lines and a serial clock signal line; both the serial data line and the serial clock signal line are connected with the serial-to-parallel conversion circuit; and the serial-to-parallel conversion circuit is further configured to read one-bit data on the serial data line when an electrical signal on the serial clock signal line satisfies a trigger condition each time.

For example, in at least one example of the gate drive circuit, the serial-to-parallel conversion circuit comprises at least two triggers cascaded; all trigger input terminals of the at least two triggers cascaded are connected with the serial clock signal line; a trigger at each stage outputs one-bit data of the parallel data frame; an input terminal of a trigger at a first stage is connected with the serial data line; and an input terminal of a trigger at any stage except the first stage is connected with an output terminal of a trigger at a previous stage of the any stage.

For example, in at least one example of the gate drive circuit, each of the at least two triggers cascaded is a D trigger.

For example, in at least one example of the gate drive circuit, the serial data interface further comprises an enable signal receiving line electrically connected with the latch circuit; and the latch circuit is configured to output the parallel data frame when an electrical signal on the enable signal receiving line is changed from a valid electrical signal to an invalid electrical signal.

For example, in at least one example of the gate drive circuit, the latch circuit comprises at least two edge triggers; all trigger input terminals of the at least two edge triggers are electrically connected with an enable signal receiving line; an input terminal of each of the at least two edge triggers receives one-bit data of the parallel data frame; and an output terminal of the each of the at least two edge triggers is capable of outputting the one-bit data of the parallel data frame.

For example, in at least one example of the gate drive circuit, the each of the at least two edge triggers is a D trigger.

For example, in at least one example of the gate drive circuit, the gate drive circuit further comprises a phase inverter. The phase inverter comprises an input terminal and an output terminal; the input terminal of the phase inverter is connected with the enable signal receiving line to receive the electrical signal on the enable signal receiving line; the phase inverter is configured to invert a phase of the electrical signal on the enable signal receiving line and output a phase-inverted signal through the output terminal of the phase inverter; and the output terminal of the phase inverter is connected with a trigger input terminal of the each of the at least two edge triggers.

For example, in at least one example of the gate drive circuit, the serial data interface is a serial bus interface of a serial peripheral interface SPI; the data frame comprises address data and mode data; the decoder circuit comprises an address decoder, a mode decoder and a plurality of electrical level changers; the address decoder takes a 2-to-4 decoder as a minimum unit and is configured to output the trigger signal to an electrical level changer corresponding to the address data in the data frame when receiving of the address data in the data frame outputted by the latch circuit is accomplished; each electrical level changer is connected with one scanning output terminal and is capable of being configured to output the scanning signal at a scanning output terminal connected with the each electrical level changer when receiving of the trigger signal outputted by the address decoder is accomplished; the mode decoder is configured to allow the plurality of scanning output terminals to all output a gate valid electrical signal voltage when receiving of the mode data in the data frame outputted by the latch circuit is accomplished and an operating mode corresponding to the mode data is an all-turned-on mode, so that the plurality of scanning output terminals all output the scanning signal; and the mode decoder is further configured to allow the plurality of scanning output terminals to all output a gate invalid electrical signal voltage when receiving of the mode data in the data frame outputted by the latch circuit is accomplished and the operating mode corresponding to the mode data is an all-turned-off mode, so that the plurality of scanning output terminals do not output the scanning signal.

For example, in at least one example of the gate drive circuit, the data frame comprises address data; and the decoder circuit is configured to output the trigger signal for generating the scanning signal at the output terminal, which is corresponding to the address data, of the decoder circuit.

For example, in at least one example of the gate drive circuit, the data frame further comprises mode data; the decoder circuit is further configured to determine a current operating mode according to the mode data in the data frame when receiving of the parallel data frame is accomplished; the current operating mode comprises a general mode; and the decoder circuit is further configured to output the trigger signal for generating the scanning signal at the output terminal, which is corresponding to the address data in the data frame, of the decoder circuit when the current operating mode is the general mode.

For example, in at least one example of the gate drive circuit, the current operating mode further comprises an all-turned-on mode; and the decoder circuit is further configured to allow the plurality of scanning output terminals to simultaneously output a gate valid electrical signal voltage when the current operating mode is the all-turned-on mode, so that the plurality of scanning output terminals all output the scanning signal.

For example, in at least one example of the gate drive circuit, the current operating mode further comprises an all-turned-off mode; and the decoder circuit is further configured to allow the plurality of scanning output terminals to simultaneously output a gate invalid electrical signal voltage when the current operating mode is the all-turned-off mode, so that the plurality of scanning output terminals do not output the scanning signal.

At least one embodiment of the present disclosure further provides a display device which comprises at least one gate drive circuit provided by any of the embodiments of the present disclosure.

For example, in at least one example of the display device, the display device further comprises a controller. The controller is configured to receive a display image, acquire a difference between the display image and a previous frame of display image, and generate at least one data frame based on the difference.

For example, in at least one example of the display device, the controller is further configured to allow each of the at least one data frame to be a serial data frame.

At least one embodiment of the present disclosure still provides a method for driving a gate drive circuit provided by any of the embodiments of the present disclosure, which comprises: sequentially sending data frames comprising address data of each scanning output terminal to the gate drive circuit when receiving of a first frame of display data is accomplished; determining a refresh scanning output terminal by comparing display data of a current frame and display data of a previous frame of the current frame when receiving of display data of any frame after the first frame of display data is accomplished; and sending a data frame comprising address data of the refresh scanning output terminal to the gate drive circuit respectively at a moment corresponding to each refresh scanning output terminal. The refresh scanning output terminal is a scanning output terminal of the plurality of scanning output terminals that needs to output the scanning signal when a display image corresponding to the display data of the previous frame is refreshed into a display image corresponding to the display data of the current frame.

BRIEF DESCRIPTION OF THE DRAWINGS

In order to clearly illustrate the technical solution of the embodiments of the disclosure, the drawings used in the description of the embodiments or relevant technologies will be briefly described in the following; it is obvious that the described drawings are only related to some embodiments of the disclosure and thus are not limitative of the disclosure.

DETAILED DESCRIPTION

Figure 1:
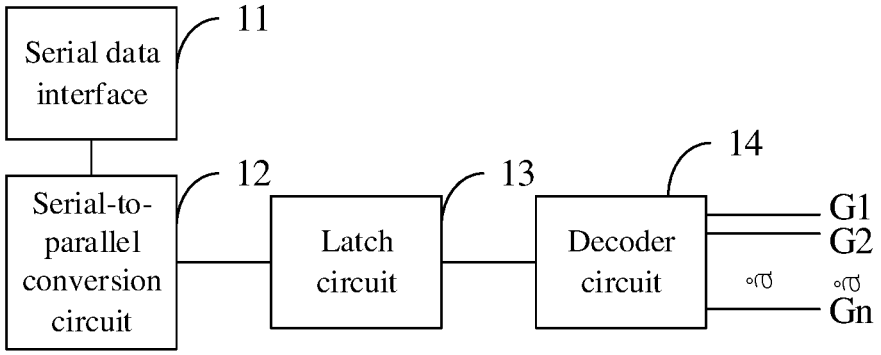
FIG. 1 is an illustrative structural block diagram of a gate drive circuit provided by some embodiments of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The inventors of the present disclosure have noticed in research that the gate drive circuit (GOA) in the related design can only realize the progressive turn-on of all the pixel rows (or a specific part of pixel rows) in the array substrate to achieve progressive data refresh, and cannot turn on only the pixels in a specified row, so the pixel rows cannot be flexibly selected for data refresh.

Embodiments of the present disclosure provides a gate drive circuit, a driving method thereof and a display device are disclosed. The gate drive circuit, comprises: a plurality of scanning output terminals and a decoder circuit. The decoder circuit comprises a plurality of input terminals and a plurality of output terminals; the plurality of output terminals of the decoder circuit are in one-to-one correspondence with the plurality of scanning output terminals; the plurality of input terminals of the decoder circuit are configured to receive a parallel data frame; and the decoder circuit is configured to output a trigger signal for generating a scanning signal at an output terminal, which is corresponding to the parallel data frame, of the decoder circuit when receiving of the parallel data frame outputted by the latch circuit is accomplished, so as to allow a scanning output terminal corresponding to the parallel data frame outputs the scanning signal.

In some examples, by adoption of a decoder, when the gate drive circuit receives one data frame, one output terminal among a plurality of scanning output terminals of the gate drive circuit outputs a scanning signal (valid signals). Thus, the gate drive circuit can provide the valid signal for one (only one) gate line and can only turn on one row of pixels connected with the above one (only one) gate line. Therefore, the gate drive circuit provided by some examples of the present disclosure can realize partial scan of the array substrate (or the display panel). For example, when the gate drive circuit is adopted to refresh one frame of display image of the display panel, the gate drive circuit may only receive several (e.g., 3 or 10) data frames. In this case, the gate drive circuit only needs to provide valid signals for several (e.g., 3 or 10) gate lines of the display panel, so as to perform data fresh on several (e.g., 3 or 10) rows of display pixels of the display panel, thereby avoiding the progressive turn-on of the display pixels of the display panel, reducing the power consumption of the display panel and the display device employing the gate drive circuit, and improving the refresh speed, the battery life and the user experience of the display panel and the display device employing the gate drive circuit.

In some examples, the gate drive circuit may also include a serial-to-parallel conversion circuit and a latch circuit. By adoption of the serial-to-parallel conversion circuit and the latch circuit, the gate drive circuit may be connected with a serial data interface and may receive data frames from a system terminal (e.g., a controller) through the serial data interface, thereby reducing the bus number (and/or circuit interface number) of the gate drive circuit and improving the universality of the gate drive circuit. For example, in the case of not needing to consider the bus number (or the circuit interface number) and the universality of the gate drive circuit, the gate drive circuit may also be not provided with the serial-to-parallel conversion circuit and the latch circuit. In this case, the gate drive circuit may receive a parallel data frame through a parallel data interface and provide the parallel data frame to the decoder, and the decoder may output a scanning signal to a scanning output terminal corresponding to the parallel data frame based on the above parallel data frame. In this case, the gate drive circuit may be not provided with the serial data interface.

In some examples, the decoder may include a mode decoder. By setting the mode decoder, the gate drive circuit may (simultaneously) provide invalid signals or valid signals for all the gate lines of the array substrate (or the display panel) through a plurality of scanning output terminals G1, G2 . . . Gn, and then can switch off or on (for example, simultaneously switch off or on) all the display pixels of the array substrate (or the display panel). It should be noted that the decoder may not include a mode decoder when it not necessary to (simultaneously) provide invalid signals or valid signals for all the gate lines of the array substrate (or the display panel). In this case, the decoder may only include an address decoder.

In some examples, relevant functions of the gate drive circuit may be all implemented by a gate circuit and transistors, and the gate circuit may be implemented by the combination of transistors and capacitors capable of being manufactured on the array substrate (may also be implemented by a field programmable gate array (FPGA)). Thus, the gate drive circuit in some examples of the present disclosure may be manufactured according to the manufacturing process of the array substrate. In this case, the array substrate and the display panel employing the gate drive circuit in some examples of the present disclosure do not need to be bonded with a chip or an external circuit, thereby reducing the production cost of the array substrate and the display panel employing the gate drive circuit provided by some examples of the present disclosure. It should be noted that when not requiring the gate drive circuit to be implemented as a GOA, partial functions of the gate drive circuit may also be implemented by circuits except the gate circuit, so as to further improve the performances of the gate drive circuit.

It should be noted that in some examples, the description that the scanning output terminal outputs a scanning signal indicates that the scanning output terminal outputs a valid signal, and the description that the scanning output terminal does not output scanning signals refers to that the scanning output terminal outputs an invalid signal.

It should be noted that in at least one embodiment of the present disclosure, the valid signal (e.g., valid electrical signal) refer to signals for switching on switching elements of relevant display pixels electrically connected with the gate drive circuit, and the invalid signals (e.g., invalid electrical signal) refer to signals for switching off switching elements of relevant display pixels electrically connected with the gate drive circuit.

Non-limitative descriptions are given to the gate drive circuit provided by at least an embodiment of the present disclosure in the following with reference to a plurality of examples. As described in the following, in case of no conflict, different features in these specific examples may be combined so as to obtain new examples, and the new examples are also fall within the scope of present disclosure.

Some embodiments of the present disclosure provide a gate drive circuit. The gate drive circuit can be used for driving an array substrate, for example, providing valid signals for the gate lines of the array substrate. FIG. 1 is an illustrative structural block diagram of the gate drive circuit provided by some embodiments of the present disclosure. As illustrated in FIG. 1, the gate drive circuit includes: a plurality of scanning output terminals G1, G2 . . . Gn; a serial data interface 11; a serial-to-parallel conversion circuit 12 connected with the serial data interface 11, a latch circuit 13 connected with the serial-to-parallel conversion circuit 12, and a decoder circuit 14 respectively connected with the latch circuit 13 and each scanning output terminal. The serial-to-parallel conversion circuit 12 is configured to receive a serial data frame through the serial data interface 11 and convert the serial data frame into a parallel data frame. The latch circuit 13 is configured to receive and store the parallel data frame and output the parallel data frame when receiving of the data frame are accomplished. The decoder circuit 14 is connected with the latch circuit 13 to receive the parallel data frame outputted by the latch circuit 13 and is configured to output a trigger signal for generating a scanning signal at the output terminal, which is corresponding to the parallel data frame, of the decoder circuit 14, so as to output the scanning signal at the scanning output terminal corresponding to the data frames.

For example, when the gate drive circuit receives a plurality of data frames, the latch circuit 13 is configured to store and output the parallel data frame corresponding to any foregoing data frame after receiving of any data frame is accomplished.

In some examples, based on the serial-to-parallel conversion circuit, the latch circuit and the decoder circuit, which are capable of being implemented on the array substrate in the form of a logical circuit, and the serial data interface, some embodiments of the present disclosure can receive a data frame through the serial data interface and select a corresponding scanning output terminal according to the data frame to output a scanning signal, so the gate drive circuit capable of being manufactured on the array substrate has the function of flexibly selecting pixels for data refresh. For example, the number of circuit interfaces can be reduced by utilization of serial communication, thereby helping simplify the internal structure of related products and improving the universality and the endurance of related products.

It should be understood that when binary data are used to form the data frame, the number of binary bits of each data frame should be matched with the number of the scanning output terminals. For example, the data frame including n (n is a positive integer) usable data bits can be used to distinguish the scanning output terminals of the gate drive circuit including at most $2^n$ scanning output terminals. For example, when n=2, binary numbers "00", "01", "10" and "11" can distinguish $2^2$=4 scanning output terminals.

Figure 2:
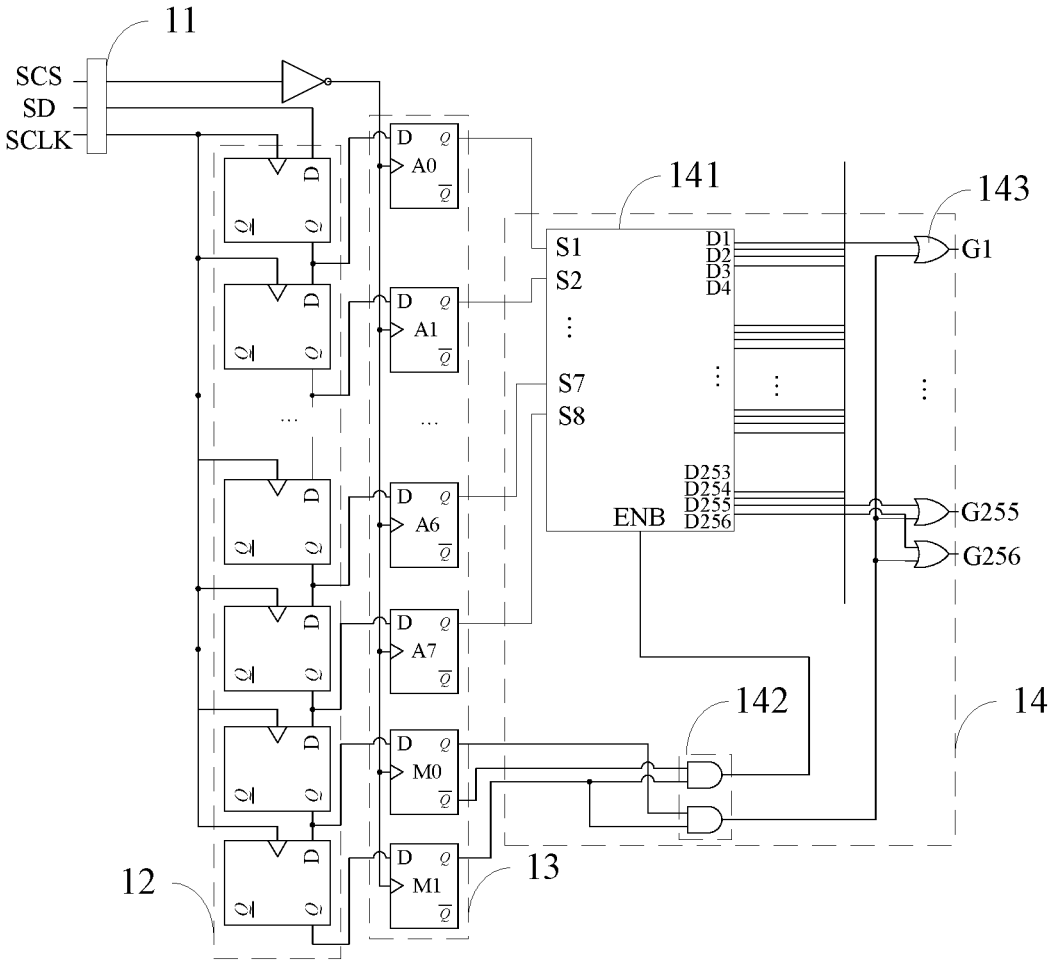
FIG. 2 is a diagram illustrating a circuit structure of a gate drive circuit provided by some embodiments of the present disclosure.
Figure 3:
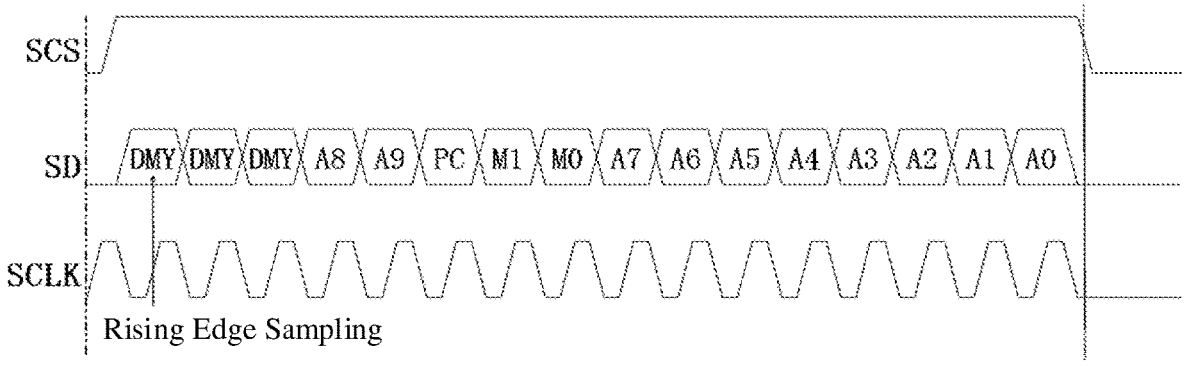
FIG. 3 is a timing diagram of a gate drive circuit provided by some embodiments of the present disclosure.

FIG. 2 is a diagram illustrating a circuit structure of the gate drive circuit provided by some embodiments of the present disclosure. FIG. 3 is a timing diagram of the above gate drive circuit. In the gate drive circuit as illustrated in FIG. 2, the serial data interface 11 includes a serial data line SD, a serial clock signal line SCLK and an enable signal receiving line SCS (for example, used for providing enable signals). As an example, the serial data interface 11 may be a serial bus interface of a serial peripheral interface SPI, and the serial bus interface transmits data according to the serial communication protocol corresponding to the serial peripheral interface SPI. In the embodiment as illustrated in FIG. 2, the gate drive circuit includes 256 scanning output terminals G1, G2 . . . G255 and G256.

For example, the structure of the data frame received by the gate drive circuit may be the structure as illustrated by the signal timing on a serial data line SD in FIG. 3, namely the data frame received by the gate drive circuit may include 16-bit binary data. Here, two binary data bits M1 and M0 are used for carrying mode data; eight binary data bits A0, A1, A2, A3, A4, A5, A6 and A7 are used for carrying address data; one binary data bits PC is a parity bit used for parity check (for example, checking whether a transmission error occurs according to whether the number of "1" in the data frame is odd or even); and five binary data bits A8, A9, and three DMYs are temporarily unused data bits. For example, when the number of the scanning output terminals is increased (for example, 1024), the above-mentioned temporarily unused data bits (for example, two data bits are additional used) are utilized to carry address data. For example, the structure of the data frame as illustrated in FIG. 3 is used for distinguishing at most $2^{13}$=8192 scanning output terminals. For example, in the case of not considering the transmission error, the parity bit can be used for carrying the address data. In this case, the structure of the data frame as illustrated in FIG. 3 can be used for distinguishing at most $2^{14}$=16384 scanning output terminals. Therefore, the structure of the data frame as illustrated in FIG. 3 allows the gate drive circuit to be applicable to drive conventional display panels.

In FIG. 2, the serial-to-parallel conversion circuit 12 includes ten upper edge D triggers. The ten upper edge D triggers are cascaded to form a shift register circuit, so as to cooperate with signals on the serial data line SD and the serial clock signal line SCLK to realize the functions of receiving the serial data frame and serial-to-parallel conversion. More specifically, the input terminal (the terminal marked as "D" in FIG. 2) of the upper edge D trigger at the first stage is connected with the serial data line SD; the input terminal of the upper edge D trigger at any stage except the first stage is connected with the output terminal (the terminal marked as "Q" in FIG. 2) of the upper edge D trigger at a previous stage of the any stage; and the trigger input terminals (the terminal marked as a triangle in FIG. 2) of the ten upper edge D triggers are all connected with the serial clock signal line SCLK, so each rising edge of the signal on the serial clock signal line SCLK triggers one shift operation—when one rising edge occurs on the serial clock signal line SCLK, each of the ten upper edge D triggers sets the electrical level at the output terminal of the each of the ten upper edge D triggers to the same electrical level as at the input terminal of the each of the ten upper edge D triggers, so as to complete one shift operation at the output terminals of the ten upper edge D triggers. For example, when the electrical level data of the output terminals of the upper edge D triggers from the first stage to the eighth stage are "1011100000" before the rising edge of the signal on the serial clock signal line SCLK arrives, the electrical level "0" on the serial data line SD replaces the electrical level at the output terminal of the upper edge D trigger at the first stage when the rising edge of the signal on the serial clock signal line SCLK arrives, and meanwhile, the electrical level at the output terminal of the upper edge D trigger at each stage replaces the electrical level at the output terminal of the upper edge D trigger at the next stage of the each stage; and the electrical level at the output terminal of the upper edge D trigger at the last stage disappears, so the electrical level data changes into "0101110000", namely all the data bits are shifted one bit to the right. It should be understood that when the serial-to-parallel conversion circuit 12 includes ten upper edge D triggers, as for the data frame structure as illustrated in FIG. 3, six data bits, namely the first three DMY, A8, A9 and PC, will disappear along with the shift operation, that is, are not utilized in the gate drive circuit as illustrated in FIG. 2. At the end, which is marked by the falling edge of the signal on the enable signal receiving line SCS, of the data frame, the output terminals of the ten upper edge D triggers retain data of ten data bits A0, A1, A2, A3, A4, A5, A6, A7, M0 and M1 in the data frame. Of course, six additional upper edge D triggers may also be set after the above ten upper edge D triggers in the serial-to-parallel conversion circuit 12 as illustrated in FIG. 2 according to the same rule, so as to receive all the data bits in the data frame.

It should be noted that for the convenience of description, in the following description, A0, A1, A2, A3, A4, A5, A6, A7, M0 and M1 are also used for describing and illustrating the upper edge D triggers of the latch circuit 13 that respectively output A0, A1, A2, A3, A4, A5, A6, A7, M0 and M1.

For example, as for a data frame whose data to be decoded include n (n is a positive integer) binary data bits, at least n-stage D triggers are used for realizing the functions of the serial-to-parallel conversion circuit 12. In the connection relationship, the trigger input terminals of at least n-stage D triggers are all connected with the serial clock signal line; the input terminal of the D trigger at the first stage is connected with the serial data line; and the input terminal of the D trigger at any stage except the first stage is connected with the output terminal of the D trigger at the previous stage of the any stage, so as to realize the structure of the above shift register circuit.

It should be noted that apart from adopting upper edge as the trigger condition of the electrical signals (namely clock signals) on the serial clock signal line, lower edge, high electrical level or low electrical level for example may also be used as the trigger condition, and the trigger condition of the electrical signals on the serial clock signal line is not limited to only the examples listed above. It can be seen that the serial-to-parallel conversion circuit can read one-bit data on the serial data line when the electrical signals on the serial clock signal line satisfy the trigger condition each time; and of course, other circuit structures capable of realizing the function of converting serial signals into parallel signals may also be adopted to realize the serial-to-parallel conversion circuit in the embodiment of the present disclosure.

In FIG. 2, the latch circuit 13 includes a plurality of upper edge D triggers; the number of the upper edge D triggers in the latch circuit 13 is equal to the number of the upper edge D triggers in the serial-to-parallel conversion circuit 12; and the input terminals of the plurality of upper edge D triggers in the latch circuit 13 are respectively connected with the plurality of upper edge D triggers in the serial-to-parallel conversion circuit 12 to respectively receive and store one-bit data of the parallel data frames.

As illustrated in FIG. 2, when the serial-to-parallel conversion circuit 12 includes ten upper edge D triggers, the latch circuit 13 includes ten upper edge D triggers, and the trigger input terminals of the ten upper edge triggers are all connected with the enable signal receiving line SCS through one phase inverter, so the ten upper edge D triggers sets the electrical level at the output terminals of the plurality of upper edge D triggers in the latch circuit 13 to be the electrical level the same with that at the input terminal under the trigger of the falling edge of the enable signal receiving line SCS, namely the output terminals of the plurality of upper edge D triggers in the latch circuit 13 respectively outputs one-bit binary data. Thus, the latch circuit 13 can output the parallel data frame from the serial-to-parallel conversion circuit 12 when the electrical level on the enable signal receiving line SCS is changes from a valid electrical signal to an invalid electrical signal.

It should be noted that valid electrical signal and invalid electrical signal in some embodiments of the present disclosure respectively refer to two different preset voltage ranges for a specific circuit node (both adopts the common terminal voltage as a reference). In one example, the valid electrical signal of all the circuit nodes is a high electrical level. In another example, the valid electrical signal of all the circuit nodes is a low electrical level. For example, as for the enable signal receiving line SCS, valid electrical signal means that a data frame is being transmitted or will be transmitted, and the transition from a valid electrical signal to an invalid electrical signal means the end of the transmission of one data frame.

For example, as for the case that the parallel data frame of the serial-to-parallel conversion circuit 12 includes n binary data bits, at least n edge D triggers may be adopted to realize the functions of the latch circuit 13. The trigger input terminals of the at least n edge D triggers are all connected with the enable signal receiving line (through one or more phase inverters); the input terminal of each edge D trigger receives one-bit data of the parallel data frame; and the output terminal of each edge D trigger outputs the one-bit data of the parallel data frame. In another example, the setting of removing the phase inverters in FIG. 2 and using ten lower edge D triggers may also be adopted to realize the function of the latch circuit 13.

It should be noted that the serial-to-parallel conversion circuit 12 and the latch circuit 13 are not limited to adopt D triggers, and according to actual application demands, the serial-to-parallel conversion circuit 12 and the latch circuit 13 may also adopt other applicable triggers.

For example, the decoder circuit includes an address decoder; the parallel data frame includes parallel address data; the address decoder includes a plurality of input terminals and a plurality of output terminals; each of the plurality of input terminals of the address decoder is configured to receive one bit of the parallel address data; and the address decoder is configured to output a trigger signal for generating the scanning signals at an output terminal, which is corresponding to the parallel address data, of the address decoder after receiving the parallel address data.

For example, the address decoder is an m-to-n decoder (e.g., 8-input 256-output decoder); m is equal to the number of the input terminals of the address decoder; and n is equal to the number of the output terminals of the address decoder. For example, the m-to-n decoder includes at least one 2-to-4 decoder.

For example, the decoder circuit also includes a mode decoder; the parallel data frame includes parallel mode data; the parallel mode data and the parallel address data are parallel to each other in the parallel data frame; and the mode decoder is configured to allow all the output terminals of the decoder to not output the trigger signals for generating the scanning signal or to output the trigger signals for generating the scanning signals when the parallel mode data correspond to the all-turned-off mode.

For example, the mode decoder includes an all-turned-off decoder; and the all-turned-off decoder is configured to provide invalid signals for the enable terminal of the address decoder when the parallel mode data correspond to an all-turned-off mode, so that all the output terminals of the decoder do not output the trigger signals for generating the scanning signals.

For example, the all-turned-off decoder includes a first AND gate (e.g., an AND gate disposed at the upper region of a mode decoder 142 in FIG. 2); the parallel mode data include first bit data (e.g., M0) and second bit data (e.g., M1); the first input terminal of the first AND gate is configured to receive data that have a phase-inverted relation with the first bit data; the second input terminal of the first AND gate is configured to receive the second bit data; and the output terminal of the first AND gate is configured to be connected with the enable terminal of the address decoder.

For example, in at least one example of the gate drive circuit, the mode decoder includes an all-turned-on decoder; and the all-turned-on decoder is configured to allow all the output terminals of the decoder to output the trigger signals for generating the scanning signals when the parallel mode data correspond to an all-turned-on mode.

For example, in at least one example of the gate drive circuit, the all-turned-on decoder includes a second AND gate (e.g., an AND gate disposed at the lower region of the mode decoder 142 in FIG. 2) and a plurality of OR gates (e.g., OR gates of a plurality of electrical level changers 143 in FIG. 2); the parallel mode data include first bit data and second bit data; the first input terminal of the second AND gate is configured to receive the first bit data; the second input terminal of the second AND gate is configured to receive the second bit data; the output terminal of the second AND gate is configured to be connected with the first input terminal of each OR gate among the plurality of OR gates; and the second input terminals of the plurality of OR gates are respectively connected with the plurality of output terminals of the address decoder.

For example, the gate drive circuit also includes a plurality of electrical level conversion circuits (not shown in FIG. 2). Each of the plurality of electrical level conversion circuits is configured to receive a trigger signal for generating a scanning signal, convert the trigger signal for generating the scanning signal into a scanning signal, and output the scanning signal through a scanning output terminal corresponding to the parallel data frame. For example, the absolute value of the electrical level of the trigger signal is about 0.1-0.6 volts. For example, the absolute value of the electrical level of the scanning signal is about 10-16 volts. For example, the input terminals of the plurality of electrical level conversion circuits are respectively connected with the output terminals of the plurality of OR gates, and the output terminals of the plurality of electrical level conversion circuits are respectively connected to the scanning output terminals of the gate drive circuit, so that the scanning signal can be outputted through a scanning output terminal corresponding to the parallel data frame. For example, each of the plurality of electrical level conversion circuits may be implemented as a transistor (e.g., a complementary metal oxide semiconductor (CMOS) transistor).

For example, illustration will be given below to the decoder circuit 14 and the electrical level conversion circuit by adoption of the example as illustrated in FIG. 2.

In FIG. 2, the decoder circuit 14 includes an address decoder 141, a mode decoder 142 and a plurality of electrical level changers 143. Here, the address decoder 141 in the embodiment as illustrated in FIG. 2 is specifically a 8-input 256-output decoder, namely a decoder that can output a valid electrical signal at an output terminal, which is corresponding to eight-bit binary data inputted through input terminals S1, S2, . . . , S7 and S8, of 256 output terminals D1, D2, D3, D4, . . . , D253, D254, D255 and D256. It can be seen that the address data correspond to the identification for identifying the scanning output terminal that need to output the scanning signal from a plurality of scanning output terminals. For example, the decimal digit data converted from the binary data "01011100" is "92". Thus, the address decoder 141 can output a valid electrical signal at the 92th output terminal when the input parallel address data are "01011100", so that the electrical level changer 143 connected with the 92th output terminal of the address decoder can output a scanning signal at the 92th output terminal, which is connected to the above electrical level changer 143, among the 256 scanning output terminals when the electrical level changer 143 receives the valid electrical signal. It can be seen that the function of the address decoder 141 is mainly to output the trigger signal (e.g., the above valid electrical signal) to the electrical level changer 143 corresponding to the address data in the data frame when receiving the address data in the data frame outputted by the latch circuit 13. In general, as for the case that the data required to be decoded include n-bit binary data, a corresponding address decoder may include n input terminals and $2^n$ output terminals.

The mode decoder 142 as illustrated in FIG. 2 adopts the working mode as illustrated in the following table to control.

TABLE 1

Working Mode Table of Decoder Circuit

| M1 | M0 | State |
|---|---|---|
| 0 | 0/1 | General mode |
| 1 | 0 | All-turned-off mode |
| 1 | 1 | All-turned-on mode |

As illustrated by the Table 1, when M1 is 0, no matter M0 is 0 or 1, the working mode of the decoder circuit 14 is a general mode; when M1 is 1 and M0 is 0, the working mode of the decoder circuit 14 is an all-turned-off mode; and when M1 is 1 and M0 is also 1, the working mode of the decoder circuit 14 is an all-turned-on mode.

As for the all-turned-off mode: as illustrated in FIG. 2, the mode decoder 142 includes two AND gates (e.g., two AND gates arranged in parallel in the vertical direction), in which one input terminal (e.g., a first input terminal) of the upper AND gate is connected with the inverted output terminal (marked as "$\overline{Q}$" in FIG. 2) of an upper edge D trigger in the latch circuit 13 corresponding to M0, and the other input terminal (e.g., a second input terminal) of the upper AND gate is connected with the output terminal of an upper edge D trigger in the latch circuit 13 corresponding to M1. Thus, when M1 is 1 and M0 is 0, the AND gate outputs a high electrical level, so the electrical level of the enable terminal ENB, which can be enabled by a low electrical level, of the address decoder 141 connected with the output terminal of the AND gate is changed into a high electrical level. In this case, the address decoder 141 will not work, and no matter the input terminal is inputted with what kind of data, the output terminals are all in invalid electrical signal. Thus, all the scanning output terminals do not output scanning signals, and then the all-turned-off control function of the gate driver can be realized through the mode data of which M1 is 1 and M0 is 0.

As for the all-turned-on mode: as illustrated in FIG. 2, one input terminal (e.g., a first input terminal) of the AND gate, disposed at the lower region of the mode decoder 142, of two AND gates is connected with the output terminal of an upper edge D trigger in the latch circuit 13 corresponding to M0, and the other input terminal (e.g., a second input terminal) of the AND gate disposed at the lower region of the mode decoder 142 is connected with the output terminal of an upper edge D trigger in the latch circuit 13 corresponding to M1. Thus, when M1 is 1 and M0 is also 1, the AND gate outputs a high electrical level. The output terminal of the AND gate is connected to one of two input terminals of each of the plurality of electrical level changers 143; each electrical level changer 143 includes one OR gate; each electrical level changer 143, for example, further includes one electrical level conversion circuit (not shown in the figure), and the input terminal of the electrical level conversion circuit is connected with the output terminal of the OR gate. Thus, in this case, no matter the output terminal of the address decoder 141 is in which state, all the scanning output terminals are set to be high electrical level by the OR gate. Therefore, the all-turned-on control function of the gate driver can be realized through the mode data of which M1 is 1 and M0 is 1.

As for the general mode: when M1 is 0 and M0 is 0 or 1, two AND gates of the mode decoder 142 output a low electrical level, so the address decoder 141 is in the operating state, and the electrical level at the output terminal of each electrical level changer 143 is the same with the electrical level at the output terminal of the address decoder 141 connected with the electrical level changer. Thus, the electrical level changer 143, connected with the output terminal of the address decoder 141 that is in a high electrical level, outputs a high electrical level. It can be understood that the high electrical level at the output terminal of the electrical level changer 143 may, for example, be a gate high electrical level voltage VGH (e.g., scanning signal), and the low electrical level at the output terminal of the electrical level changer 143 may, for example, be a gate low electrical level voltage VGL, thereby realizing the function of outputting a scanning signal at the connected scanning output terminal when receiving the trigger signals outputted by the address decoder 141. For example, the voltage value of the gate high electrical level voltage VGH is greater than the voltage value of the gate low electrical level voltage VGL. For example, the absolute value of the gate high electrical level voltage VGH is 10-16 volts, and the gate low electrical level voltage VGL is zero volts. For another example, the absolute values of the gate high electrical level voltage VGH and the gate low electrical level voltage VGL are both 10-16 volts, and the gate low electrical level voltage VGL is a negative value.

For example, the process executed by the decoder circuit 14 in the above example is equivalent to: determine the current working mode according to the mode data in the data frame, so as to an output scanning signal at the scanning output terminal corresponding to the address data in the data frame when the current mode is a general mode, simultaneously output gate valid electrical signal voltages at a plurality of scanning output terminals when the current working mode is an all-turned-on mode, and simultaneously output gate invalid electrical signal voltages at the plurality of scanning output terminals when the current working mode is an all-turned-off mode.

For example, in one implementation of the present disclosure, the mode decoder 14 is configured to switch on a plurality of scanning output terminals to the gate valid electrical signal voltage (for example, the plurality of scanning output terminals all output gate valid electrical signal voltages) when the mode data in the data frame outputted by the latch circuit 13 are received and the working mode corresponding to the mode data is an all-turned-on mode; and/or the mode decoder 14 is configured to switch on the plurality of scanning output terminals to the gate invalid electrical signal voltage (for example, the plurality of scanning output terminals all output the gate invalid electrical signal voltages) when the mode data in the data frame outputted by the latch circuit 13 are received and the working mode corresponding to the mode data is an all-turned-off mode. Here, the gate valid electrical signal voltage is one of the gate high electrical level voltage VGH and the gate low electrical level voltage VGL, and the gate invalid electrical signal voltage is the other one of the gate high electrical level voltage VGH and the gate low electrical level voltage VGL. Of course, other applicable circuit structures may also be adopted to realize the mode decoder in embodiments of the present disclosure.

For example, after the normal display is finished (or in the shutdown phase of the display panel), the all-turned-on function of the gate drive circuit may be used to switch on all the switching elements in all the display pixels of the display panel and release charges, thereby avoiding the afterimage problem of the display device. For example, after the charges are released, the all-turned-off function of the gate drive circuit may be used to switch off all the switching elements in all the display pixels of the display panel, thereby preparing for the next-time use of the display panel.

Figure 4:
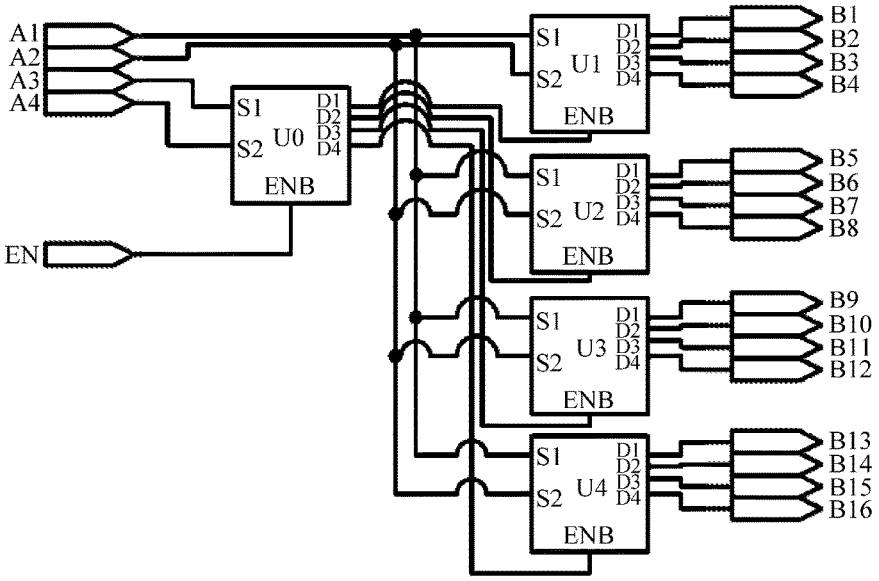
FIG. 4 is an illustrative structural block diagram of a part of an address decoder in a gate drive circuit provided by some embodiments of the present disclosure.

FIG. 4 is a structural block diagram of a part of an address decoder (namely 4-to-16 decoder) in the gate drive circuit provided by some embodiments of the present disclosure. It can be seen that the 4-to-16 decoder as illustrated in FIG. 4 includes an enable signal input terminal (e.g., an enable signal input terminal EN as illustrated in FIG. 4), four input terminals (e.g., input terminals A1, A2, A3 and A4 as illustrated in FIG. 4) and sixteen output terminals (e.g., output terminals B1, B2, B3, B4, B5, B6, B7, B8, B9, B10, B11, B12, B13, B14, B15, B16 as illustrated in FIG. 4). The 8-input 256-output decoder as illustrated in FIG. 2 may be formed by seventeen 4-to-16 decoders as illustrated in FIG. 4, in which one 4-to-16 decoder is taken as a master decoder, and the other sixteen 4-to-16 decoders are taken as slave decoders. For example, four input terminals of the master decoder are configured to receive data of four-bit data at high-order data bits in the address data (namely A4, A5, A6, A7 in FIG. 3), and four input terminals of each slave decoder among the sixteen slave decoders are configured to receive data of four-bit data at low-order data bits in the address data (namely A0, A1, A2, A3 in FIG. 3). For example, the enable terminal of the master decoder is connected with the output terminal of the all-turned-off decoder (namely the output terminal of a first AND gate), and the enable terminals of the sixteen slave decoders are respectively connected with sixteen output terminals of the master decoder.

Detailed description will be given below to the 4-to-16 decoders as illustrated in FIG. 4. As illustrated in FIG. 4, the 4-to-16 decoder may be formed by five 2-to-4 decoders U0, U1, U2, U3, U4 (the five 2-to-4 decoders may have same structure). Two input terminals (e.g., input terminals S1 and S2 as illustrated in FIG. 4) of the 2-to-4 decoder U0 (namely the master decoder of the 4-to-16 decoder) are connected with two input terminals A3 and A4, corresponding to two high-order data bits, of the address decoder, and four output terminals (e.g., input terminals D1, D2, D3 and D4 as illustrated in FIG. 4) of the 2-to-4 decoder U0 are respectively connected with enable terminals ENB of other four 2-to-4 decoders (namely 4 slave decoders of the 4-to-16 decoder) after the 2-to-4 decoder U0. In addition, the input terminals of the four 2-to-4 decoders after the 2-to-4 decoder U0 are all connected with two input terminals A1 and A2, corresponding to two low-order data bits, of the address decoder, and the output terminals of each 2-to-4 decoder are respectively connected with a group of output terminals (e.g., 4 output terminals) of the address decoder. Thus, the 2-to-4 decoder U0 can decompose the decryption of 4-bit binary data into the decryption of 4 sets of 2-bit binary data; according to the size of the data, four kinds of data with the high-order data bits "11", four kinds of data with the high-order data bits "10", four kinds of data with the high-order data bits "01", and four kinds of data with the high-order data bits "00" sequentially decrease. Therefore, when the high-order data bits is "11", the 2-to-4 decoder U4 may be adopted for addressing within the range of "11XX" according to the two low-order data bits; when the high-order data bits is "10", the 2-to-4 decoder U3 may be adopted for addressing within the range of "10XX" according to the two low-order data bits; when the high-order data bits is "01", the 2-to-4 decoder U2 may be adopted for addressing within the range of "01XX" according to the two low-order data bits; and when the high-order data bits is "00", the 2-to-4 decoder U1 may be adopted for addressing within the range of "00XX" according to the two low-order data bits. It can be seen that one 4-to-16 decoder can be formed by five 2-to-4 decoders through the above combination.

Similarly, five above 4-to-16 decoders can form one 8-256 decoder which can serve as the address decoder 141 as illustrated in FIG. 2.

Figure 5:
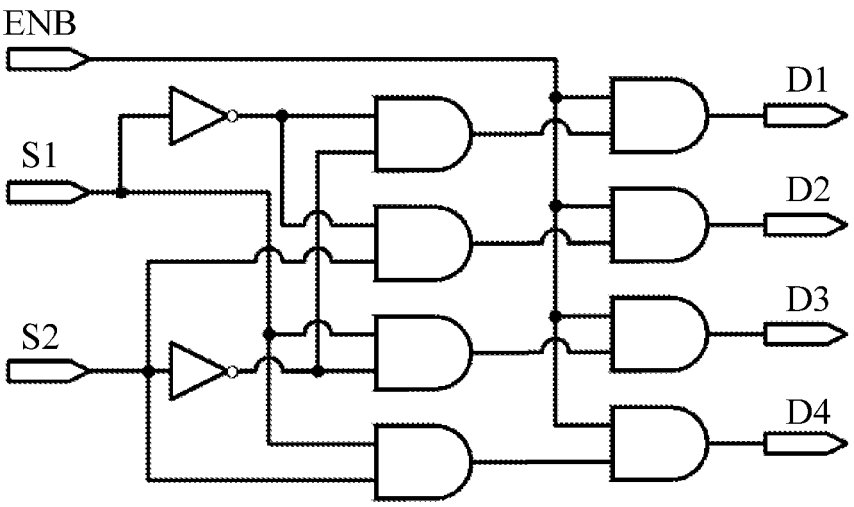
FIG. 5 is a diagram illustrating a circuit structure of a 2-to-4 decoder provided by some embodiments of the present disclosure.

FIG. 5 is a circuit diagram of a 2-to-4 decoder in some embodiments of the present disclosure. In FIG. 5, a logical circuit composed of two NOT gates and eight AND gates realizes the functions of the 2-to-4 decoder. Based on this, any address decoder can be implemented by a plurality of 2-to-4 decoders, which serves as the minimum units, by utilization of the combination principle as illustrated in FIG. 4, and each 2-to-4 decoder may be implemented in the form of a gate circuit. In addition, the upper edge D trigger as illustrated in FIG. 2 may also be implemented in the form of a gate circuit with reference to related technologies. Thus, the gate drive circuit as illustrated in FIG. 2 may all be implemented by a gate circuit, and the gate circuit may be implemented by a combination of transistors and capacitors capable of being manufactured on the array substrate (may also be implemented by a field programmable gate array (FPGA)), so the gate drive circuit in the present disclosure not only can output a scanning signal at a corresponding scanning output terminal according to received data frame but also can be combined with the manufacturing process of the array substrate. Thus, the gate drive circuit can be realized without requiring bonding a chip or an external circuit. Therefore, the gate drive circuit capable of being manufactured on the array substrate can flexibly select pixel rows for data refresh, thereby simplifying the internal structure of relevant products and improving the universality of relevant products. Moreover, because the serial data interface composed of three lines as illustrated in FIG. 2 can cover all the inputs of the gate drive circuit, compared with the prior art, embodiments of the present disclosure can also utilize serial communication to reduce the number of circuit interfaces, thereby helping simplify the internal structure of relevant products. Finally, because the gate drive circuit can flexibly select pixel rows for data refresh, flexible partial refresh or single-row refresh can be realized, thereby helping reduce the power consumption caused by the output of the scanning signals and improving the universality and the duration of relevant products.

Figure 6:
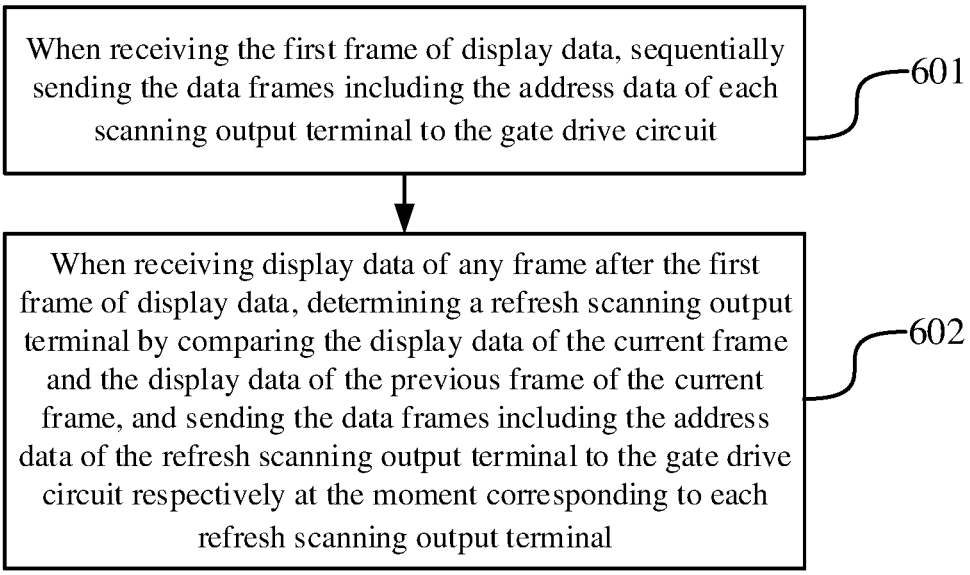
FIG. 6 is a schematic flowchart of a driving method of a gate drive circuit provided by some embodiments of the present disclosure.

FIG. 6 is a schematic flowchart of a driving method of a gate drive circuit provided by some embodiments of the present disclosure. The gate drive circuit may be any foregoing gate drive circuit. As illustrated in FIG. 6, the driving method comprises:

S601: when receiving the first frame of display data, sequentially sending the data frames including the address data of each scanning output terminal to the gate drive circuit.

S602: when receiving display data of any frame after the first frame of display data, determining a refresh scanning output terminal by comparing the display data of the current frame and the display data of the previous frame of the current frame, and sending the data frames including the address data of the refresh scanning output terminal to the gate drive circuit respectively at the moment corresponding to each refresh scanning output terminal.

The refresh scanning output terminal refers to a scanning output terminal that needs to an output scanning signal among the plurality of scanning output terminals when a display image corresponding to the display data of the previous frame is refreshed into a display image corresponding to the display data of the current frame.

In one example, when receiving the display data of the first frame of image, any foregoing gate drive circuit may be controlled to sequentially output the scanning signals at each scanning output terminal, so as to complete the data refresh of the entire display region. When the display data of any frame of image is received after receiving the first frame of image, only the part, that has changed compared with the previous frame, of the any frame of image may be refreshed—it is possible to determine pixel rows corresponding to which scanning output terminals have display data changes by comparing the display data, so that the output of the gate driver can be suspended during the refresh periods corresponding to scanning output terminals other than the scanning output terminals corresponding to pixel rows, display data of which have changed, and the gate drive circuit is controlled to adaptively output the scanning signals only during the refresh periods corresponding to the scanning output terminals corresponding to pixel rows, display data of which have changed. Therefore, the refresh process of pixel rows of which the image data have no change can be omitted, so the overall power consumption can be reduced.

Figure 7:
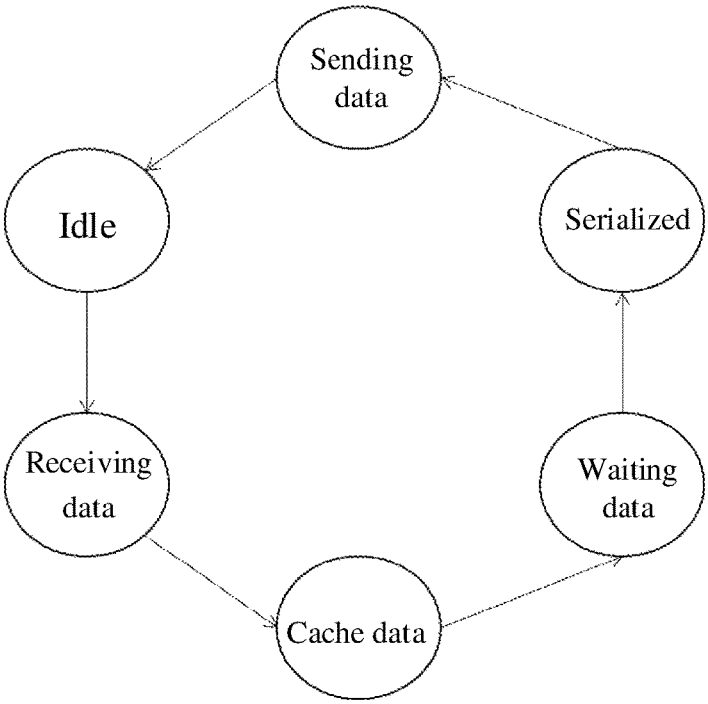
FIG. 7 is a diagram illustrating a change of a data transmission state of a serial data interface in some embodiments of the present disclosure.

FIG. 7 is a diagram illustrating a change of a data transmission state of a serial data interface in some embodiments of the present disclosure. As illustrated in FIG. 7, corresponding to the working principle and the circuit timing of the gate drive circuit, the data transmission state of the serial data interface may be circularly executed according to the sequence of "idle", "receiving data" (acquiring data to be sent), "cache data", "waiting data" (waiting for the time to send), "serialized" (converted into serial data), "sending data", "idle" . . . . Thus, it can cooperate with any foregoing gate drive circuit to achieve the effect of flexibly selecting pixel rows for data refresh.

Still another embodiment of the present disclosure provides a display device, which comprises at least one foregoing gate drive circuit.

For example, the display device may further include a controller. The controller is configured to receive a display image (namely the current display image), acquire the difference between the display image and the previous frame of display image, and generate at least one data frame based on the difference. For example, a black image may be taken as the zero frame of display image. When the controller receives the first frame of display image, the controller may acquire the difference between the first frame of display image and the black image, and generate at least one data frame (e.g., J data frames) according to the difference between the first frame of display image and the black image. For example, the case that the controller generates the J data frames indicates that, in order to display the current display image, and the gate drive circuit must provide scanning signals (valid signals) for J gate lines, so that J rows of pixels of the display panel can be refreshed.

For example, in at least one example of the display device, the controller is further configured to allow each of the at least one data frame to be a serial data frame, so the gate drive circuit can receive the serial data frame.

The controller may comprise a processor and a memory. The processor, for example, is a central processing unit (CPU) or a processing unit in other forms having data processing capability and/or instruction execution capability. For example, the processor may be implemented as a general-purpose processor and may also be a single chip computer, a microprocessor, a digital signal processor (DSP), a special-purpose image processing chip, a field programmable logic array (FPLA), and the like. The memory, for example, may include a volatile memory and/or a non-volatile memory, for example, may include a read-only memory (ROM), a hard disk, a flash memory, and the like. Correspondingly, the memory may be implemented as one or more computer program products. The computer program products may include computer readable storage media in various forms. One or more computer program instructions may be stored in the computer readable storage medium. The processor may run the program instructions to realize the function of the control device in the embodiment of the present disclosure as described below and/or other desired functions. The memory may also store various other application programs and various data, and various data used by and/or generated by application programs.

The display device provided by the embodiment of the present disclosure may be: any product or component with display function such as a display panel, a mobile phone, a tablet PC, a TV, a display, a notebook computer, a digital album or a navigator. Based on the advantages that can be achieved by the gate drive circuit, the display device can also achieve the same or corresponding advantages.

Figure 8:
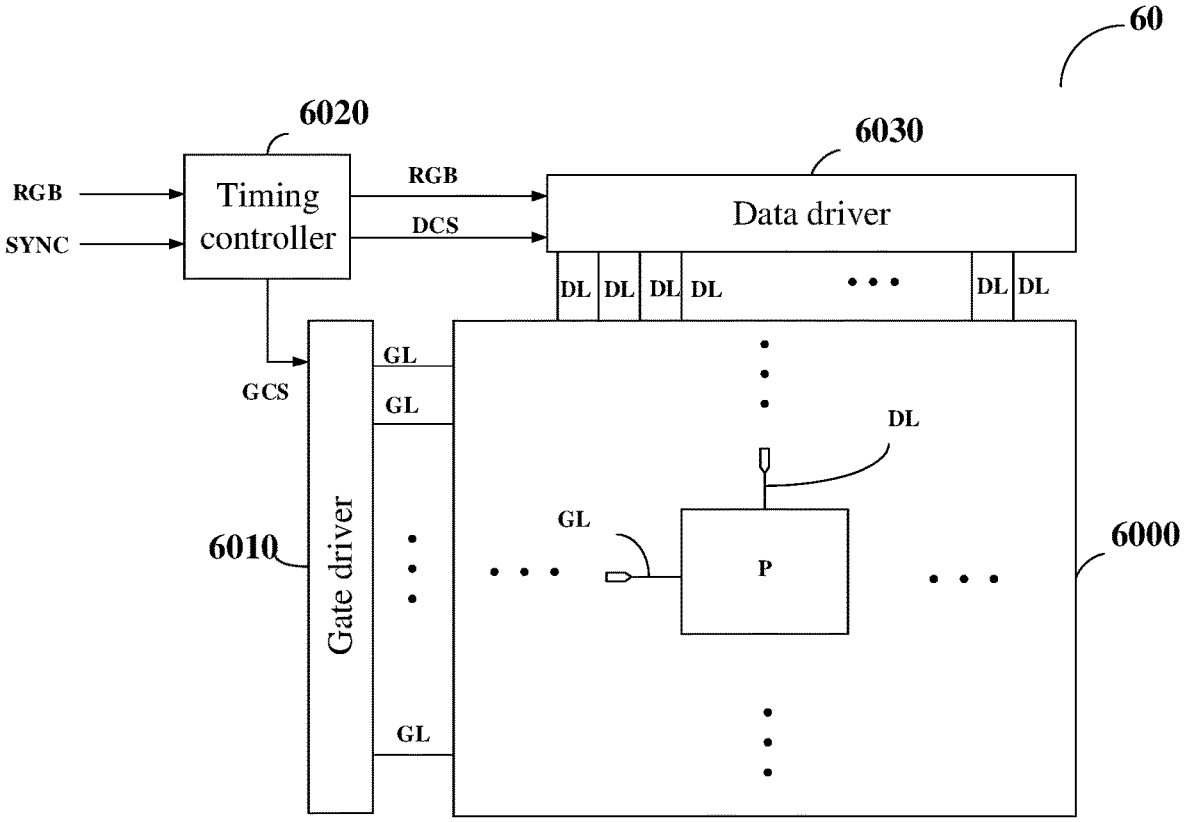
FIG. 8 is an illustrative block diagram of a display device provided by some embodiments of the present disclosure.

FIG. 8 is an illustrative block diagram of a display device provided by some embodiments of the present disclosure. Illustration will be given below to the display device provided by some embodiments of the present disclosure with reference to FIG. 8.

As illustrated in FIG. 8, a display device 60 comprises a display panel 6000, a gate driver 6010, a timing controller 6020 and a data driver 6030. The display panel 6000 includes a plurality of pixel units P which are defined by the intersection of a plurality of gate lines GL and a plurality of data lines DL.

For example, the gate driver 6010 includes a gate drive circuit provided by any foregoing embodiment. The gate driver 6010 includes a plurality of output terminals, and the plurality of output terminals of the gate driver 6010 are respectively connected with the plurality of gate lines GL, so that the gate driver 6010 can be used for driving the plurality of gate lines GL.

For example, the data driver 6030 is configured to drive the plurality of data lines DL. For example, the timing controller 6020 is configured to process image data RGB inputted from the outside of the display device 60, provide processed image data RGB for the data driver 6030, and respectively output gate control signals GCS and data control signals DCS to the gate driver 6010 and the data driver 6030, so as to control the gate driver 6010 and the data driver 6030.

For example, the display device may further comprise a controller. The controller, for example, may be implemented as the timing controller 6020 or be disposed in the timing controller 6020. For example, the timing controller 6020 may be connected with the serial data line SD, the serial clock signal line SCLK and the enable signal receiving line SCS, so as to respectively provide data frames, clock signals and enable signals for the gate driver 6010 through the serial data line SD, the serial clock signal line SCLK and the enable signal receiving line SCS.

Although detailed description has been given above to the present disclosure with general description and embodiments, it shall be apparent to those skilled in the art that some modifications or improvements may be made on the basis of the embodiments of the present disclosure. Therefore, all the modifications or improvements made without departing from the spirit of the present disclosure shall all fall within the scope of protection of the present disclosure.

What are described above is related to the illustrative embodiments of the disclosure only and not limitative to the scope of the disclosure; the scopes of the disclosure are defined by the accompanying claims.

What is claimed is:

1. A gate drive circuit, comprising: a plurality of scanning output terminals and a decoder circuit, wherein the decoder circuit comprises a plurality of input terminals and a plurality of output terminals;

the plurality of output terminals of the decoder circuit are in one-to-one correspondence with the plurality of scanning output terminals;

the plurality of input terminals of the decoder circuit are configured to receive a parallel data frame; and the decoder circuit is configured to output, in response to receiving of the parallel data frame outputted by a latch circuit, a trigger signal for generating a scanning signal at an output terminal, which is corresponding to the parallel data frame, of the decoder circuit, so as to allow a scanning output terminal corresponding to the parallel data frame outputs the scanning signal, wherein the data frame comprises address data; and the decoder circuit is configured to output the trigger signal for generating the scanning signal at the output terminal, which is corresponding to the address data, of the decoder circuit; and the data frame further comprises mode data, an all-turned-on mode, and an all-turned-off mode;

the decoder circuit is further configured to determine a current operating mode according to the mode data in the data frame when receiving of the parallel data frame is accomplished;

the current operating mode comprises a general mode;

the decoder circuit is further configured to output the trigger signal for generating the scanning signal at the output terminal, which is corresponding to the address data in the data frame, of the decoder circuit when the current operating mode is the general mode;

the decoder circuit is further configured to allow the plurality of scanning output terminals to simultaneously output a gate valid electrical signal voltage when the current operating mode is the all-turned-on mode, so that the plurality of scanning output terminals all output the scanning signal; and the decoder circuit is further configured to allow the plurality of scanning output terminals to simultaneously output a gate invalid electrical signal voltage when the current operating mode is the all-turned-off mode, so that the plurality of scanning output terminals do not output the scanning signal.

2. The gate drive circuit according to claim 1, further comprising:

a serial-to-parallel conversion circuit configured to receive a serial data frame and convert the serial data frame into the parallel data frame; and a latch circuit connected with the serial-to-parallel conversion circuit, wherein the latch circuit is configured to receive and store the parallel data frame and output the parallel data frame after receiving of the parallel data frame is accomplished; and the decoder circuit is connected with the latch circuit to receive the parallel data frame outputted by the latch circuit and configured to output the trigger signal for generating the scanning signal at the output terminal, which is corresponding to the parallel data frame, of the decoder circuit when receiving of the parallel data frame outputted by the latch circuit is accomplished.

3. The gate drive circuit according to claim 1, wherein the decoder circuit comprises an address decoder;

the parallel data frame comprises parallel address data;

the address decoder comprises a plurality of input terminals and a plurality of output terminals;

each of the plurality of input terminals of the address decoder is configured to receive one-bit data of the parallel address data; and the address decoder is configured to output the trigger signal for generating the scanning signal through an output terminal, which is corresponding to the parallel address data, of the address decoder after receiving of the parallel address data is accomplished.

4. The gate drive circuit according to claim 3, wherein the address decoder is an m-to-n decoder; and m is equal to a number of the input terminals of the address decoder, and n is equal to a number of the output terminals of the address decoder.

5. The gate drive circuit according to claim 3, wherein the decoder circuit further comprises a mode decoder;

the parallel data frame further comprises parallel mode data, and the parallel mode data and the parallel address data are parallel to each other in the parallel data frame; and the mode decoder is configured to allow all the output terminals of the decoder to not output the trigger signal for generating the scanning signal when the parallel mode data correspond to an all-turned-off mode or all output the trigger signal for generating the scanning signal when the parallel mode data correspond to an all-turned-on mode.

6. The gate drive circuit according to claim 5, wherein the mode decoder comprises an all-turned-off decoder;

the all-turned-off decoder is configured to provide an invalid signal for an enable terminal of the address decoder when the parallel mode data correspond to the all-turned-off mode, so that all the output terminals of the decoder do not output the trigger signal for generating the scanning signal;

the all-turned-off decoder comprises a first AND gate;

the parallel mode data comprise first bit data and second bit data;

a first input terminal of the first AND gate is configured to receive data that have a phase-inverted relationship with the first bit data;

a second input terminal of the first AND gate is configured to receive the second bit data; and an output terminal of the first AND gate is configured to be connected with the enable terminal of the address decoder.

7. The gate drive circuit according to claim 5, wherein the mode decoder comprises an all-turned-on decoder;

the all-turned-on decoder is configured to allow all the output terminals of the decoder to all output the trigger signal for generating the scanning signal when the parallel mode data correspond to the all-turned-on mode;

the all-turned-on decoder comprises a second AND gate and a plurality of OR gates;

the parallel mode data comprise first bit data and second bit data;

a first input terminal of the second AND gate is configured to receive the first bit data;

a second input terminal of the second AND gate is configured to receive the second bit data;

an output terminal of the second AND gate is configured to be connected with a first input terminal of each OR gate of the plurality of OR gates; and second input terminals of the plurality of OR gates are respectively connected with the plurality of output terminals of the address decoder.

8. The gate drive circuit according to claim 3, further comprising an electrical level conversion circuit, wherein the electrical level conversion circuit is configured to receive the trigger signal for generating the scanning signal, convert the trigger signal for generating the scanning signal into the scanning signal, and allow the scanning signal to be outputted through the scanning output terminal corresponding to the parallel data frame.

9. The gate drive circuit according to claim 2, further comprising a serial data interface, wherein the serial-to-parallel conversion circuit is connected with the serial data interface to receive the serial data frame through the serial data interface.

10. The gate drive circuit according to claim 9, wherein the serial data interface comprises a serial data lines and a serial clock signal line;

both the serial data line and the serial clock signal line are connected with the serial-to-parallel conversion circuit; and the serial-to-parallel conversion circuit is further configured to read one-bit data on the serial data line when an electrical signal on the serial clock signal line satisfies a trigger condition each time.

11. The gate drive circuit according to claim 2, wherein the serial-to-parallel conversion circuit comprises at least two triggers cascaded;

all trigger input terminals of the at least two triggers cascaded are connected with the serial clock signal line;

a trigger at each stage outputs one-bit data of the parallel data frame;

an input terminal of a trigger at a first stage is connected with the serial data line; and an input terminal of a trigger at any stage except the first stage is connected with an output terminal of a trigger at a previous stage of the any stage.

12. The gate drive circuit according to claim 9, wherein the serial data interface further comprises an enable signal receiving line electrically connected with the latch circuit; and the latch circuit is configured to output the parallel data frame when an electrical signal on the enable signal receiving line is changed from a valid electrical signal to an invalid electrical signal.

13. The gate drive circuit according to claim 2, wherein the latch circuit comprises at least two edge triggers;

all trigger input terminals of the at least two edge triggers are electrically connected with an enable signal receiving line;

an input terminal of each of the at least two edge triggers receives one-bit data of the parallel data frame; and an output terminal of the each of the at least two edge triggers is capable of outputting the one-bit data of the parallel data frame.

14. The gate drive circuit according to claim 13, further comprising a phase inverter, wherein the phase inverter comprises an input terminal and an output terminal;

the input terminal of the phase inverter is connected with the enable signal receiving line to receive the electrical signal on the enable signal receiving line;

the phase inverter is configured to invert a phase of the electrical signal on the enable signal receiving line and output a phase-inverted signal through the output terminal of the phase inverter; and the output terminal of the phase inverter is connected with a trigger input terminal of the each of the at least two edge triggers.

15. The gate drive circuit according to claim 9, wherein the serial data interface is a serial bus interface of a serial peripheral interface SPI;

the data frame comprises address data and mode data;

the decoder circuit comprises an address decoder, a mode decoder and a plurality of electrical level changers;

the address decoder takes a 2-to-4 decoder as a minimum unit and is configured to output the trigger signal to an electrical level changer corresponding to the address data in the data frame when receiving of the address data in the data frame outputted by the latch circuit is accomplished;

each electrical level changer is connected with one corresponding scanning output terminal and is capable of being configured to output the scanning signal at a scanning output terminal connected with the each electrical level changer when receiving of the trigger signal outputted by the address decoder is accomplished;

the mode decoder is configured to allow the plurality of scanning output terminals to all output a gate valid electrical signal voltage when receiving of the mode data in the data frame outputted by the latch circuit is accomplished and an operating mode corresponding to the mode data is an all-turned-on mode, so that the plurality of scanning output terminals all output the scanning signal; and the mode decoder is further configured to allow the plurality of scanning output terminals to all output a gate invalid electrical signal voltage when receiving of the mode data in the data frame outputted by the latch circuit is accomplished and the operating mode corresponding to the mode data is an all-turned-off mode, so that the plurality of scanning output terminals do not output the scanning signal.

16. A display device, comprising at least one gate drive circuit according to claim 1.

17. The display device according to claim 16, further comprising a controller, wherein the controller is configured to receive a display image, acquire a difference between the display image and a previous frame of display image, and generate at least one data frame based on the difference; and the controller is further configured to allow each of the at least one data frame to be a serial data frame.

18. A method for driving the gate drive circuit according to claim 1, comprising:

sequentially sending data frames comprising address data of the plurality of scanning output terminals of the gate drive circuit to the gate drive circuit when receiving of a first frame of display data is accomplished;

determining at least one refresh scanning output terminal by comparing display data of a current frame and display data of a previous frame of the current frame when receiving of display data of any frame after the first frame of display data is accomplished; and sending a data frame comprising address data of each of the at least one refresh scanning output terminal to the gate drive circuit at a moment corresponding to the each of the at least one refresh scanning output terminal, wherein the at least one refresh scanning output terminal is at least one scanning output terminal of the plurality of scanning output terminals that needs to output the scanning signal when a display image corresponding to the display data of the previous frame is refreshed into a display image corresponding to the display data of the current frame.

* * * * *